US006205605B1

(12) United States Patent
Orsat

(10) Patent No.: US 6,205,605 B1
(45) Date of Patent: Mar. 27, 2001

(54) METHOD OF CONSTRUCTION OF A VAULT, BEARING PIECE AND HALF-SHELL FOR CONSTRUCTION OF THE VAULT

(75) Inventor: Pierre Orsat, Velizy Villacoublay (FR)

(73) Assignee: Freyssinet International (STUP) (FR)

( * ) Notice: Subject to any disclaimer, the term of this patent is extended or adjusted under 35 U.S.C. 154(b) by 0 days.

(21) Appl. No.: 09/363,503

(22) Filed: Jul. 29, 1999

(30) Foreign Application Priority Data

Jul. 29, 1998 (FR) ..... 98 09688

(51) Int. Cl.[7] ..... E01D 4/00; E01F 5/00; E03F 3/00; E04B 1/32

(52) U.S. Cl. ..... 14/26; 14/24; 14/77.1; 405/124; 405/126; 52/86; 52/320

(58) Field of Search ..... 14/24, 26, 77.1; 404/1, 71, 72; 405/124, 126, 258, 272, 275; 52/86, 320, 259, 578

(56) References Cited

U.S. PATENT DOCUMENTS

| | | | | |
|---|---|---|---|---|
| 571,225 | * | 11/1896 | Geisel | 14/26 |
| 886,666 | * | 5/1908 | Thomas | 14/26 |
| 3,374,497 | * | 3/1968 | Meheen | 14/26 |
| 4,349,491 | | 9/1982 | Eyden | 264/35 |
| 5,503,504 | * | 4/1996 | Hess et al. | 405/282 |

FOREIGN PATENT DOCUMENTS

| | | | |
|---|---|---|---|
| 495 469 | 8/1970 | (CH) | E01G/3/00 |
| 2 751 675 | 1/1998 | (FR) | E02D/29/05 |
| WO 9603552 | 2/1996 | (WO) | E02D/29/05 |

* cited by examiner

*Primary Examiner*—Eileen D. Lillis
*Assistant Examiner*—Gary S. Hartmann
(74) *Attorney, Agent, or Firm*—Pennie & Edmonds LLP

(57) ABSTRACT

Method of construction of a vault, in which at least two half-shells (1–8; 60) are brought to bear against one another by means of at least two bearing pieces (30, 50; 70) which are mated and, each half-shell (1–8; 60) comprising an upper edge (21; 61) and a bottom lip (22); each bearing piece (30, 50; 70) is fixed removably to a half-shell (1–8; 60), the two half-shells (1–8; 60) are brought to bear against one another temporarily via their bearing piece (30, 50; 70) without their bottom lips (22) being brought to bear against one another, a keystone-forming material is cast between said upper edges (21; 61), on the bottom (14) constituted by the lips (22), so as to bring about continuous transverse joining together of the half-shells (1–8; 60), and then the bearing pieces (30, 50; 70) are removed so as to effect load transfer from the bearing pieces (30, 50; 70) to the half-shells (1–8; 60). The invention is suitable for the construction of a passage under an embankment.

14 Claims, 2 Drawing Sheets

METHOD OF CONSTRUCTION OF A VAULT, BEARING PIECE AND HALF-SHELL FOR CONSTRUCTION OF THE VAULT

FIELD OF THE INVENTION

The invention relates to the construction of vaulted structures such as underpasses or overpasses for roads and motorways and other similar constructions.

BACKGROUND OF THE INVENTION

The document SAMFLO FR 2 751 675 discloses a method of construction of a vault, in which two half-shells, provided with a lip and bearing braces, are positioned on continuous footings constructed on site. The two half-shells are then brought to bear against one another, by means of the braces, and a continuity keystone is cast between the upper edges of the two half-shells, on the lips, so as to construct a keystone which brings about continuous transverse joining together of the half-shells.

The braces, by means of which the half-shells bear against one another before the keystone is formed, are embedded in the concrete and are thus lost. However, these braces make up a certain percentage of the cost of construction of a vault. The applicant has therefore sought to reduce the cost induced by these braces.

From FR 2 723 116 (PREFAC), a method of construction of a vault using at least two half-shells each comprising a bottom lip was known, in which the two half-shells are brought to bear against one another, lip against lip, with a compressible block being interposed, and, in order to avoid any relative escape of the two half-shells and thus achieve secure bearing, the two lips are connected by means of a metal plate which is fixed to the lower faces of the lips. The plate is positioned after the block and, consequently, after the compression of the latter and after the half-shells have been brought to bear against one another. The result is that the plate does not participate in the half-shells being brought to bear against one another. Concrete is then cast onto the bottom lips, between the two half-shells, so as to produce a longitudinal keystone beam.

In the PREFAC invention, the block and the plate are normally removable. However, as the block is compressed between the two half-shells, it proves impossible to remove it later. Moreover, if the block is interposed between the lips, it is the latter which support the bearing load of the two half-shells on one another, even after the keystone concrete has been cast, and not the longitudinal keystone beam. The result is that the vault constructed in this manner is liable to premature wear.

In the SAMFLO invention (FR 2 751 675), there is no transfer of the bearing load from the braces to the keystone either. Indeed, it is by means of the braces, embedded in the concrete, that the half-shells bear against one another not only before the concrete is cast but after casting also.

SUMMARY OF THE INVENTION

To this end, the invention relates to a method of construction of a vault, in which at least two half-shells are brought to bear against one another by means of at least two bearing pieces which are mated and, each half-shell comprising an upper edge and a bottom lip, a keystone-forming material is cast between said upper edges, on the bottom constituted by the lips, so as to bring about continuous transverse joining together of the half-shells, which method is characterized in that each bearing piece is fixed removably to a half-shell, the two half-shells are brought to bear against one another temporarily via their bearing piece without their bottom lips being brought to bear against one another, and the bearing pieces are removed after the keystone-forming material has been cast, so as to effect load transfer from the bearing pieces to the half-shells.

By virtue of the invention, the bearing braces can be reused later for the construction of another vault.

In the present invention, by virtue of the removal of the bearing pieces, load transfer from the bearing pieces to the half-shells is effected with certainty.

It is possible to arrange the bearing pieces at least partly above the half-shells or at least partly below the half-shells.

In the prior art, the braces cluttered the space between the two half-shells and consequently obstructed the installation of continuity reinforcement. By virtue of the invention, this disadvantage is also eliminated.

In a particular embodiment, two pluralities of half-shells are placed end to end in two longitudinal rows and each half-shell of one of the rows is brought to bear against a half-shell of the other row by means of at least two bearing pieces, male and female respectively, which are mated so that the bearing pieces of one of the two types support the bearing pieces of the other type.

By virtue of this, the bearing points of the half-shells on one another are all at the same level, which ensures greater stability of the vault and a completely continuous appearance on the soffit.

The invention also relates to a bearing piece for bringing about the bearing against one another of the half-shells of the vault constructed according to the above method, comprising a transverse bearing arm, which piece comprises removable fixing means essentially at right angles to the transverse arm.

The invention also relates to a half-shell for construction of the vault according to the above method, which half-shell comprises means of receiving a bearing piece.

BRIEF DESCRIPTION OF THE DRAWINGS

The invention will be better understood with the aid of the description below of a vault, of the method of construction of the vault, of half-shells of the vault, and of bearing pieces for the construction of the vault, with reference to the appended drawing, in which.

DETAILED DESCRIPTION OF THE PREFERRED EMBODIMENTS

Figure 1:
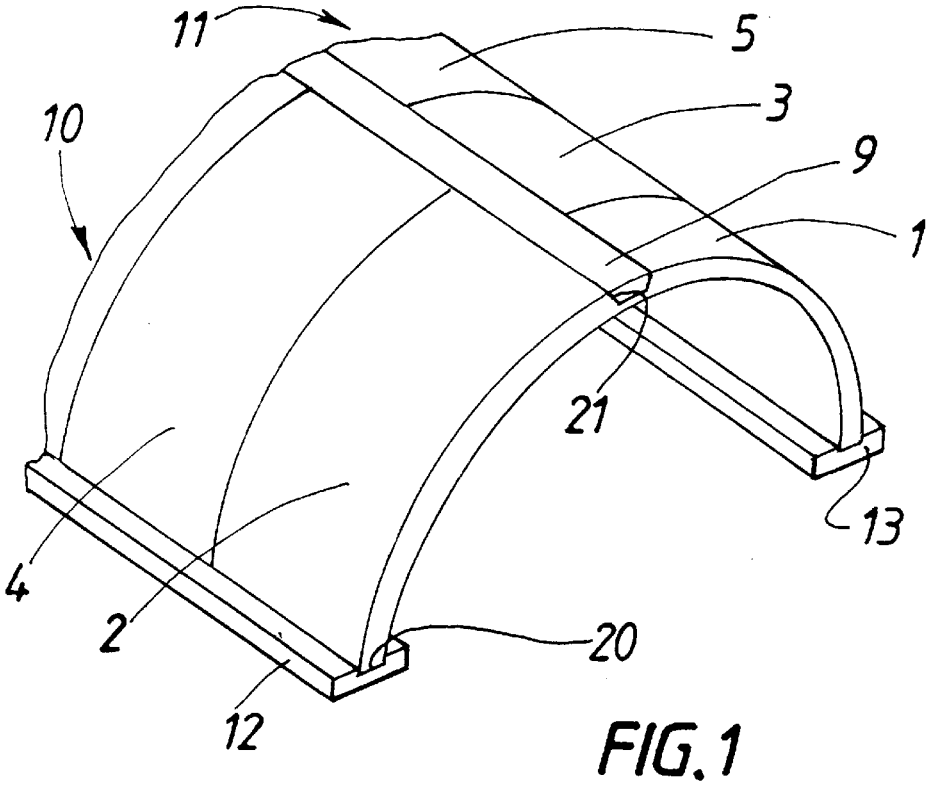
FIG. 1 shows a perspective view of the vault, after the bearing pieces have been removed, according to a particular embodiment.

The vault shown in FIG. 1 is intended for the construction of an underpass under an embankment and comprises two longitudinal rows 10, 11 of prefabricated half-shells 1–8, in this case made of concrete, which are arranged end to end on either side of a vertical longitudinal centre plane P and are joined together transversely by a keystone 9. Two parallel support footings 12, 13 support the two longitudinal rows of half-shells 10, 11.

The vault comprises four end half-shells 1, 2, 7, 8 (two at each end) and in this case four intermediate half-shells 3–6 located between the end half-shells 1, 2, 7, 8. The two end half-shells 1 and 8 have a width 1 equal to half the width L of the other half-shells 2–7. The half-shells 3, 5 and 7 of the row 10 are offset by a half-width 1 of a half-shell in the longitudinal direction in relation to the half-shells 2, 4 and 6 of the other row 11. The half-shells 1–8 of the vault are thus arranged in a staggered manner. It will be noted that the width of a half-shell means the dimension of this half-shell in the longitudinal direction of the vault.

Figure 2:
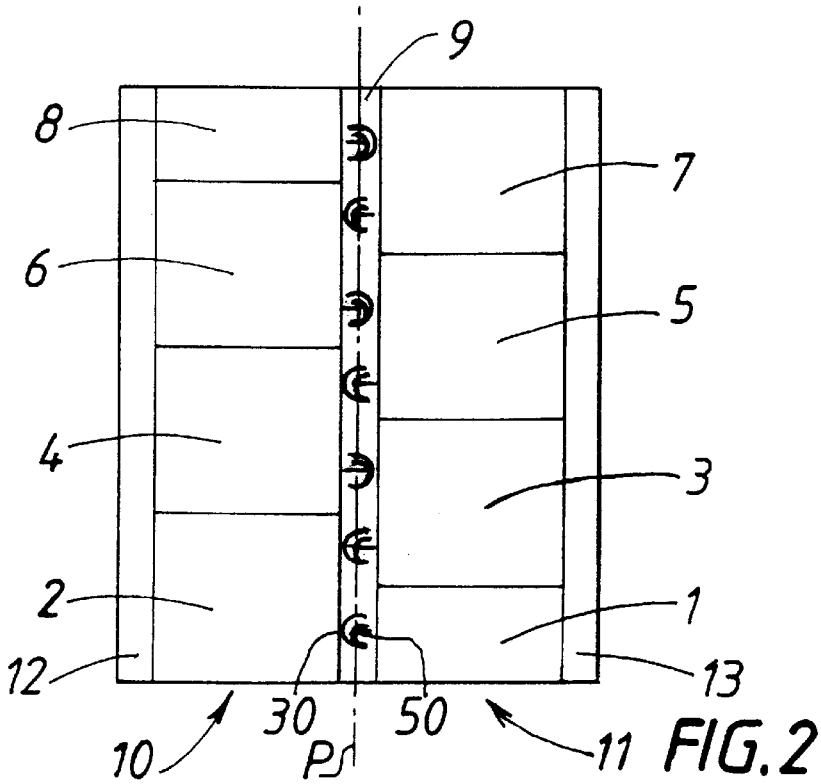
FIG. 2 shows a view from above of the vault in FIG. 1, before removal of the bearing pieces.
Figure 3:
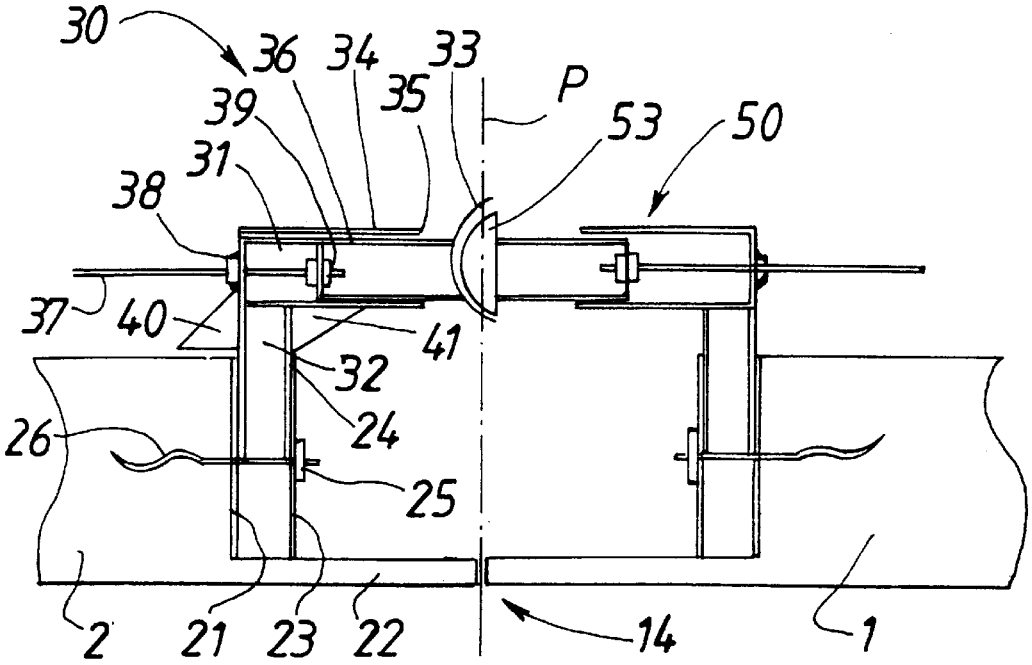
FIG. 3 shows a lateral view of two mated bearing pieces from FIG. 2.
Figure 4:
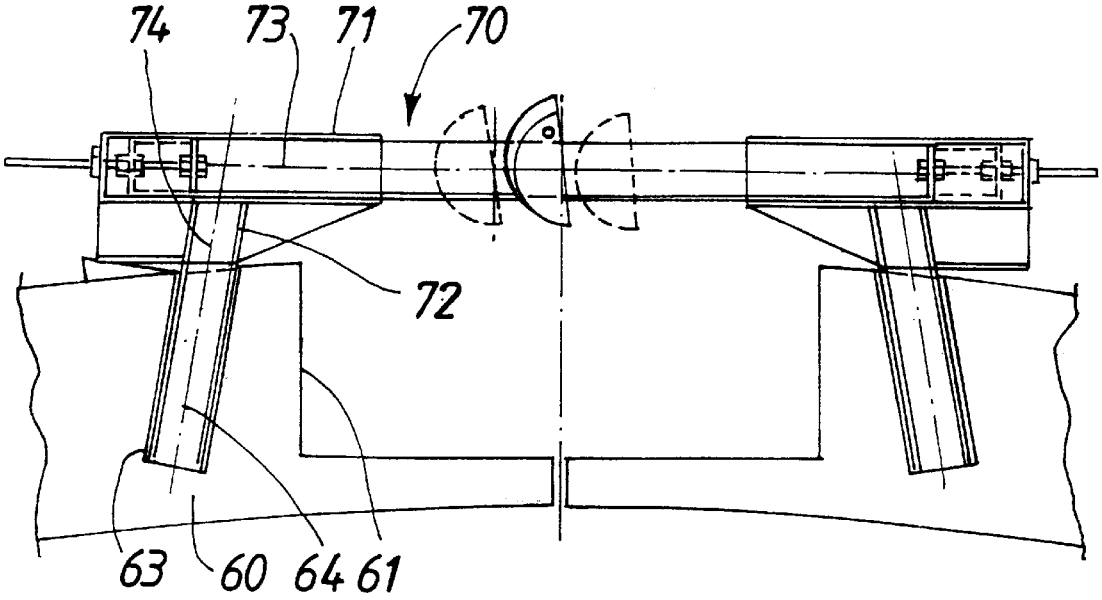
FIG. 4 shows a lateral view of two mated bearing pieces, according to an alternative embodiment.

During construction of the vault (FIG. 2), each half-shell of one of the longitudinal rows 10 (11) is brought to bear against a half-shell of the other longitudinal row 11 (10) by means of two temporary bearing pieces, or "bearing braces", 30, 50, male and female respectively, which are mated. FIG. 3 shows two mated bearing pieces 30, 50, by means of which the half-shell 2 bears against the half-shell 1.

The half-shells 2–7 of length L are all identical. For the sake of clarity, only the half-shell 2 will now be described.

The half-shell 2, which constitutes a portion of the wall of the vault, comprises a lower bearing edge 20 and an upper edge 21 which is essentially vertical in its functional position. A lip 22, which forms the bottom wall for the casting of the keystone as will be explained below, extends the upper edge 21 essentially at right angles and extends in continuation of the lower face of the half-shell 2.

The half-shell 2 also comprises two external shoes, or sleeves, 23 for receiving a bearing piece, which are fixed to the upper edge 21 of the half-shell and arranged essentially at a quarter and three quarters the width of the half-shell respectively. Each shoe 23 consists of a tube, or sleeve, or square section, comprising an upper opening 24 for the passage of a fixing foot of the bearing piece, the opening 24 extending in the plane of the upper face of the half-shell 2. The shoe 23 is laid flat against the upper edge 21, via one of its lateral faces, and fixed to the half-shell 2 by means of a threaded anchoring rod 26 and a nut 25 screwed onto the rod 26.

The end half-shells 1 and 8 of length l are similar to the half-shell 2 described above, the only difference being that they comprise only one external shoe for receiving a fixing foot of a bearing piece, which shoe is arranged at essentially half the width of the half-shell.

The female bearing pieces 30 comprise a transverse bearing arm and a removable fixing foot 32.

The term "transverse" is used to describe something which extends at right angles to a vertical plane extending in the longitudinal direction of the vault.

The transverse bearing arm 31 also comprises an external tube 34 of square section which is open at one of its ends via an opening 35, and an internal tube 36 mounted slidingly in the external tube 34 and provided, at one of its ends, with a female bearing head 33 projecting from the external tube 34 via the opening 35. The bearing head 33 is concave and forms a cavity for receiving a convex male bearing head 53.

The internal tube 36 and the external tube 34 are interconnected by a transverse threaded rod 37 fixed to the bottom wall of the internal tube 36, at the end opposite the bearing head 33, by a fixing system 39 and extending through the bottom wall of the external tube 34 at the end opposite the opening 35. A nut 38 is mounted on the portion of the threaded rod 37 projecting from the external tube 34 and is welded to the bottom wall of the external tube 34. The telescopic bearing arm 31 is thus length-adjustable by screwing and unscrewing the rod 37.

The removable fixing foot 32, which is integral with the transverse bearing arm 31, is at right angles to the latter and supported by stiffeners 40, 41. The fixing foot 32, which is intended to be fitted removably into an external receiving shoe of a half-shell, has a square section of dimensions which are essentially the same as those of the internal section of the shoe.

The male bearing pieces 50 differ from the female bearing pieces 30 only in that they comprise a male bearing head 53 of convex shape instead of the female bearing head 33.

The concave and convex shapes of, respectively, the bearing head 33 of a female bearing piece 30 and of the bearing head 53 of a male bearing piece 50 are such that they afford vertical and horizontal support of one of the bearing pieces 30 (50) by the other bearing piece 50 (30) after the two pieces 30, 50 have been mated by introduction of the male bearing head 53 into the female bearing head 33.

The method of construction of the vault will now be described.

1) Fixing the bearing pieces to the half-shells

The male bearing pieces 50 and female bearing pieces 30 are fixed removably to the half-shells 1–8. For each bearing piece to be fixed to a half-shell, the fixing foot of the bearing piece is fitted into an external receiving shoe of the half-shell by passage through the upper opening of the shoe, arranging the bearing piece partly above the half-shell.

A male bearing piece and a female bearing piece are fixed to the intermediate half-shells 3–6 and to the end half-shell 7. The male bearing piece and the female bearing piece are arranged in a given manner in relation to one another on each of the half-shells 3, 5, 7 intended for the construction of one of the longitudinal rows 11 of the vault. The relative arrangement of the two, male and female bearing pieces is reversed on the half-shells 4, 6 intended for the construction of the other longitudinal row 10.

Two bearing pieces of the same type, in this case female, are fixed removably to the half-shell 2 which will be the first half-shell to be positioned during the construction of the vault.

Finally, a single bearing piece, in this case male, is fixed removably to each of the end half-shells 1, 8 provided with only one shoe.

By screwing or unscrewing the rods 37, it is possible, if necessary, to compensate for any manufacturing defects due to tolerance deviations so as to ensure good mating of the half-shells.

2) Bringing the half-shells to bear against one another

The length of the bearing arms of the male bearing pieces 50 and female bearing pieces 30 is adjusted in such a manner that the contact surface of the mated bearing pieces of each mating pair extends essentially in the longitudinal centre plane P of the vault.

The two bearing footings 12, 13 are constructed, forming in each of them a groove for receiving the lower bearing edges of the half-shells 1–8.

The end half-shell 2 is positioned on one or the continuous footings 12 and stabilized. One 1 of the end half-shells of length l is then positioned in the continuous footing 13 and is brought to bear on the half-shell 2 by means of the male bearing piece 50 of the half-shell 1 and one of the female bearing pieces 30 of the half-shell 2, which are mated.

The intermediate half-shell 3 is then positioned on the continuous footing 13, next to the half-shell 1, and it is brought to bear against the half-shell 2 by means of the male bearing piece of the half-shell 3 and the available female bearing piece of the half-shell 2, which are mated.

The half-shells are then brought to bear against one another step by step, the two pluralities of half-shells 1, 3, 5, 7 and 2, 4, 6, 8 being arranged end to end in the two longitudinal rows 10, 11. The respective half-shells 1–8 of the two rows 10, 11 are thus arranged in a staggered manner. Each half-shell of one of the rows 10 (11) is brought to bear against a half-shell of the other row 11 (10) by means of two temporary bearing pieces 30, 50, male and female respectively, which are mated.

During mating of a male bearing piece 50 and a female bearing piece 30, the male bearing piece 50 is brought to bear against the female bearing piece 30 in such a manner that the female bearing piece 30 supports the male bearing piece 50. All the female bearing pieces 30 of the vault thus support the male bearing pieces 50.

The final half-shell positioned is the end half-shell 8 of length l which is brought to bear against the end half-shell 7.

When two half-shells are brought to bear against one another, the lips of the half-shells come to be positioned facing one another without bearing against one another, forming a bottom 14.

After the half-shells 1–8 have been brought to bear against one another, a keystone-forming material, in this case concrete, is cast between the upper edges of the half-shells, on the bottom 14, so as to construct a keystone 9 which brings about continuous transverse joining together of the half-shells 1–8.

3) Removal of the temporary bearing pieces

After the keystone has been cast and has set, the male bearing pieces 30 and female bearing pieces 50 of each pair of mated bearing pieces are separated from one another by unscrewing the rod 37 of one 31 of the bearing arms of the mated pair. In this way, load transfer from the bearing pieces 30, 50 to the half-shells 1–8 is effected. After the bearing pieces 30, 50 have been drawn back, the transverse bearing load of each pair of half-shells brought to bear against one another is thus supported by the keystone 9.

Each of the bearing pieces 30 (50) is then removed, its fixing foot 32 being removed from the shoe, in which it is fitted, by displacement vertically upwards.

In the description which has just been given, the bearing pieces are paired so that the female bearing pieces support the male bearing pieces. The bearing pieces could also be mated by bringing the female bearing pieces to bear against the male bearing pieces in such a manner that the male bearing pieces support the female bearing pieces.

A preferred alternative embodiment of the bearing pieces and of the half-shells differs from the preceding description only in what will now be described.

The half-shells 60 comprise, in place of the external shoes 23, internal shoes 63 embedded in the thickness of the half-shell 60, short of the upper edge 61 of the latter. Each shoe 63 consists of a sleeve of square section and with a longitudinal axis 64. This axis is in this case slightly inclined in relation to the vertical, the distance between the axis 64 and the upper edge 61 of the half-shell 60 decreasing in the upward direction.

The male and female bearing pieces 70 comprise a transverse bearing arm 71 and a fixing foot 72 intended to be fitted into an internal shoe 63.

The bearing arm 71, similar to that described previously, extends along an axis 73.

The fixing foot 72 has a square section, which is the same as the internal section of the shoe 63, and extends along an axis 74 essentially at right angles to the transverse arm 71. The angle formed between the axis 73 and the axis 74 and located on the side of the bearing head of the bearing arm 71 is slightly greater than 90°.

The procedure for fixing the bearing pieces 70 to the half-shells 60, for bringing the half-shells 60 to bear against one another and for removing the bearing pieces 70 is as described previously.

It is to be underlined that the inclination of the fixing foot 72 and of the internal shoe 63 for receiving this foot increases the friction between the foot 72 and the shoe 63. The result is better clamping of the foot 72 in the shoe 63 and consequently better fixing of the bearing piece 70 to the half-shell 60.

After the bearing pieces 70 have been removed, concrete is cast into the internal shoes 63.

In an alternative embodiment, in place of the shoes, each half-shell comprises at least one hole formed in its upper face, short of the upper edge, in which an internally threaded bush is placed. The bush does not pass through the thickness of the half-shell. The temporary bearing pieces comprise a transverse bearing arm and, in place of the fixing foot, a passage for receiving a fixing bolt with an axis at right angles to the transverse bearing arm.

To fix a bearing piece removably to a half-shell, a fixing bolt is introduced into the receiving passage of the bearing piece and it is screwed into the bush. To remove the bearing arm, the bolt is unscrewed.

In the preceding description, the bearing pieces are arranged at least partly above the half-shells. The bearing pieces could just as well be arranged partly below the half-shells.

What is claimed is:

1. A method of construction of a vault, in which at least two half-shells (1–8; 60) are brought to bear against one another by means of at least two bearing pieces (30, 50; 70) which are mated and, each half-shell (1–8; 60) comprising an upper edge (21; 61) and a bottom lip (22), a keystone-forming material is cast between said upper edges (21; 61), on the bottom (14) constituted by the lips (22), so as to bring about continuous transverse joining together of the half-shells (1–8; 60), which method is characterized in that each bearing piece (30, 50; 70) is fixed removably to a half-shell (1–8; 60), the two half-shells (1–8; 60) are brought to bear against one another temporarily via their bearing piece (30, 50; 70) without their bottom lips (22) being brought to bear against one another, and the bearing pieces (30, 50; 70) are removed after the keystone-forming material has been cast, so as to effect load transfer from the bearing pieces (30, 50; 70) to the half-shells (1–8; 60).

2. The method as claimed in claim 1, wherein the bearing pieces (30, 50; 70) are arranged at least partly above the half-shells (1–8; 60).

3. The method as claimed in claim 1, wherein the bearing pieces are arranged at least partly below the half-shells.

4. The method as claimed in claim 1, wherein each bearing piece (30; 70) is fixed to a half-shell (2) by fitting a fixing foot (32; 72) of said piece (30; 70) into a receiving shoe (23; 63) integral with the half-shell (2; 60).

5. The method as claimed in claim 1, wherein the two mated pieces (30, 50; 70) are separated in order to effect the load transfer.

6. The method as claimed in claim 1, wherein two pluralities of half-shells (1–8; 60) are placed end to end in two longitudinal rows (10, 11) and each half-shell of one of the rows is brought to bear against a half-shell of the other row by means of at least two bearing pieces (30, 50; 70), male and female respectively, which are mated so that the bearing pieces of one of the two types support the bearing pieces of the other type.

7. The method as claimed in claim 1, wherein the vault is constructed with end half-shells (1, 2, 7, 8) and intermediate half-shells (3–6), two bearing pieces, male (50) and female (30) respectively, are fixed to each intermediate half-shell (3–6), and the respective half-shells (1–8) of the two rows (10, 11) are arranged in a staggered manner.

8. A bearing piece for bringing about the bearing against one another of the half-shells of the vault constructed according to the method of claim 1, comprising a transverse bearing arm (31; 71), characterized by the fact that said piece comprises removable fixing means (32; 72) essentially at right angles to the transverse arm (31; 71).

9. The bearing piece as claimed in claim 8, wherein a passage for receiving a fixing bolt is provided.

10. The bearing piece as claimed in claim 8, wherein the fixing means comprise a fixing foot (32; 72).

11. The bearing piece as claimed in claim 8, wherein the bearing arm (31; 71) is length-adjustable.

12. A half-shell for the construction of the vault according to the method of claim 1, characterized in that it comprises means (23; 63) for removably receiving a bearing piece.

13. The half-shell as claimed in claim 12, wherein the means for receiving a bearing piece comprise an external shoe (23).

14. The half-shell as claimed in claim 12, wherein the means for receiving a bearing piece comprise an internal shoe (63).

* * * * *